United States Patent [19]

Rose

[11] 4,352,249

[45] Oct. 5, 1982

[54] FRUIT DRYER

[75] Inventor: Boyd W. Rose, Riverside, Calif.

[73] Assignee: FMC Corporation, Chicago, Ill.

[21] Appl. No.: 195,466

[22] Filed: Oct. 9, 1980

[51] Int. Cl.[3] ..... F26B 15/12

[52] U.S. Cl. ..... 34/212; 34/216; 34/225; 99/483; 426/305; 426/465; 432/145

[58] Field of Search ..... 426/305, 308, 310, 455, 426/456, 465; 99/475, 477, 483; 432/128, 145, 152; 34/31, 33, 34, 35, 86, 212, 216, 217, 225

[56] References Cited

U.S. PATENT DOCUMENTS

| | | | |
|---|---|---|---|
| 1,932,124 | 10/1933 | Tobey | 34/217 |
| 2,752,250 | 6/1956 | Kasser | 426/305 |
| 4,216,592 | 8/1980 | Koch | 34/160 |

*Primary Examiner*—Larry I. Schwartz
*Attorney, Agent, or Firm*—R. B. Megley

[57] ABSTRACT

A fruit dryer comprising a roller conveyor passing through an elongate drying chamber is disclosed. An air plenum having a plurality of transverse nozzle openings is disposed above the conveyor and directs a series of curtain-like air streams on the fruit below. The major portion of the air within the dryer is recycled by a fan while a smaller portion of said air is exhausted by a second fan. A heater heats both the recycled air and fresh air introduced as make-up for the exhausted air. A means is provided to rotate the individual rollers of the roller conveyor as the conveyor is advanced in order to expose all sides of the fruit to the air streams.

9 Claims, 6 Drawing Figures

FRUIT DRYER

BACKGROUND OF THE INVENTION

1. Field of the Invention

The present invention relates generally to forced-air dryers. More particularly, it relates to a high capacity dryer for fruit and the like.

2. Description of the Prior Art

Both citrus fruits and apples are often treated with wax preservatives before being sent to market. In the past, the wax preservatives were usually sprayed onto the fruit in solution with a volatile solvent. Due to environmental restrictions placed on the emissions of such volatile solvents, however, preservatives are now most often sprayed on fruit as a water-based emulsion. Since water is less volatile than the solvents previously used, drying of the fruit has become more difficult. If the fruit is not adequately dried prior to packing, individual pieces of fruit will stick together making them more difficult to handle and marring their appearance.

The prior art fruit dryer typically comprised an enclosed chamber having a roller conveyor running axially therethrough. Forced-air heaters were provided to discharge hot air into the space above the conveyor and extract air from the space below the conveyor. In this way, heated air would be drawn generally down through the conveyor in order to dry the fruit carried thereon. Separate fans located in the enclosure were used to help distribute the heated air more evenly. Such a fruit dryer is illustrated in Bulletin HCFD 2M/WA 7/74 of the FMC Corporation.

The prior art dryer, although functional, operated inefficiently. The air flow through the dryer and downward past the conveyor was nonuniform. While some areas in the dryer received abundant quantities of heated air, others received an inadequate supply. To insure that all fruit was sufficiently dried, it was necessary to increase the total flow of air so that even the "dead spots" in the dryer had sufficient air flow. Such operation required a higher power consumption than would be required with a uniform distribution of air.

A second deficiency of the prior art arose when more than one layer of fruit was carried by the conveyor. The contact areas between adjacent fruit were not dried because they are not exposed to air flow. This problem was partly overcome by using a roller conveyor having freely rotating rollers. By periodically contacting the underside of the rollers with fixed pads, the rollers are intermittently rotated causing the fruit to revolve and the fruit contact areas to change. Such intermittent rotation, however, is relatively rapid and causes the fruit being carried on the conveyor to slip. When the fruit slips, the wet spots are not exposed and do not dry. Additionally, by periodically starting and stopping the rotation of individual rollers, the fruit located in a valley between a turning roller and an idle roller will sometimes be pinched.

A final problem with the prior art has been the inadequate control of humidity within the dryer. The prior art dryer worked by recirculating air within the dryer itself. Some air leakage occurred and air lost from the system was made up by fresh air input to the forced-air fan. It will be appreciated that the air being recirculated into the heater would often be saturated with moisture and additional moisture-carrying capacity could be added only by further heating of said air. On humid days, this would require very high air temperatures to achieve any drying at all.

SUMMARY OF THE INVENTION

The fruit dryer of the present invention comprises a conveyor disposed within an enclosed chamber. A plenum disposed axially above the conveyor and within the chamber includes a number of transverse nozzle openings which extend across the width of the conveyor. Heated air is supplied to the plenum and directed downward thereby onto the fruit carried by the conveyor. The use of a plenum having a number of transverse nozzle openings provides uniform air flow throughout the dryer which eliminates "dead spots" and allows for more efficient operation.

To further insure that the fruit is dried evenly over its entire surface, the conveyor may be provided with a means to slowly rotate individual rollers which comprise the conveyor surface in order to revolve the fruit and expose all surfaces thereof. The means for rotating the rollers is provided on the second half of the conveyor only so that a major portion of the water has been evaporated from the fruit surfaces prior to rotation.

Finally, a fan may be provided to expel moist air from the dryer in order to control the humidity of the air being recirculated therein. By expelling moist air and introducing fresh air, the moisture content of the air being circulated is reduced.

DESCRIPTION OF THE PREFERRED EMBODIMENT

Figure 1:
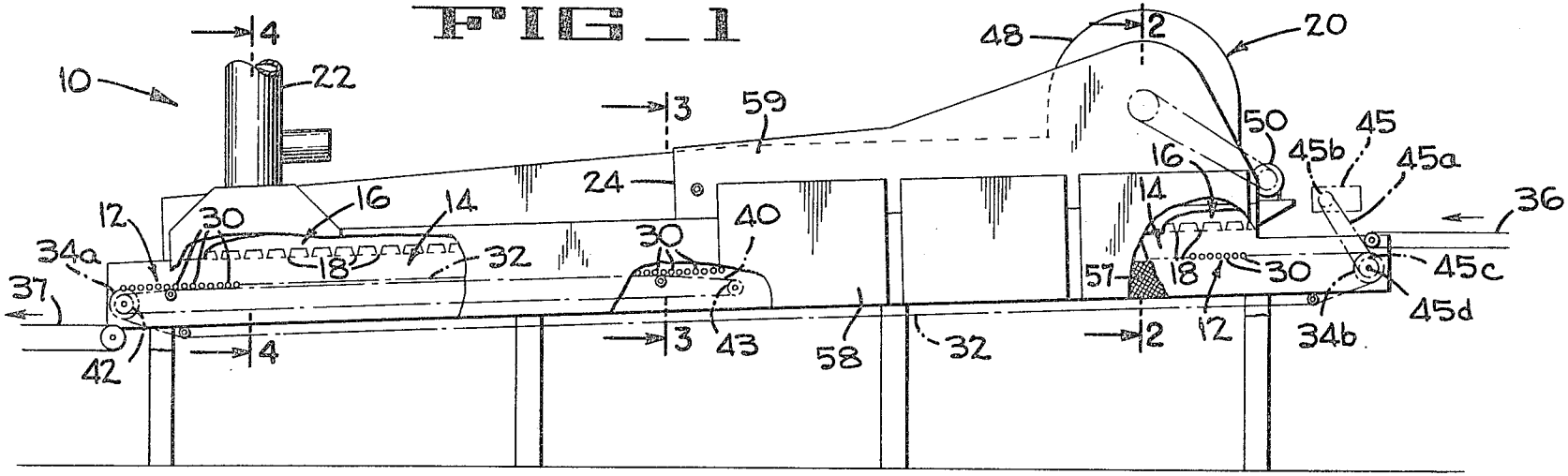
FIG. 1 is a side elevation of the dryer of the present invention with portions being broken away.

Referring to FIG. 1, the present invention is a dryer 10 comprising a conveyor 12 which carries the fruit to be dried through a substantially enclosed chamber 14. The roof of the chamber 14 is formed by an air plenum 16 having a plurality of nozzle outlets 18 extending across the width thereof. A fan 20 forces air into the plenum 16, which in turn directs the air downward onto fruit being carried by the conveyor 12. The conveyor 12 is a roller conveyor and the air passes between adjacent rollers into the space below the conveyor where the major portion of the air is collected and recirculated to the inlet of the fan 20. A purge stream of air is expelled through an exhaust stack 22 and make-up air enters through an inlet duct 24. A heater (not illustrated) is provided in the inlet duct 24 to heat both the inlet air and the air which is being recirculated from beneath the conveyor.

The dryer 10 operates by directing a plurality of curtain-like air streams downward onto the fruit being carried by the conveyor 12. By providing such narrow curtains of high velocity air, the air is able to penetrate up to two layers of fruit, as will be described in detail hereinafter. As an additional aid to uniform drying, individual rollers 30 of the roller conveyor 12 are slowly rotated during a portion of their travel, typically the second one-half.

Figure 2:
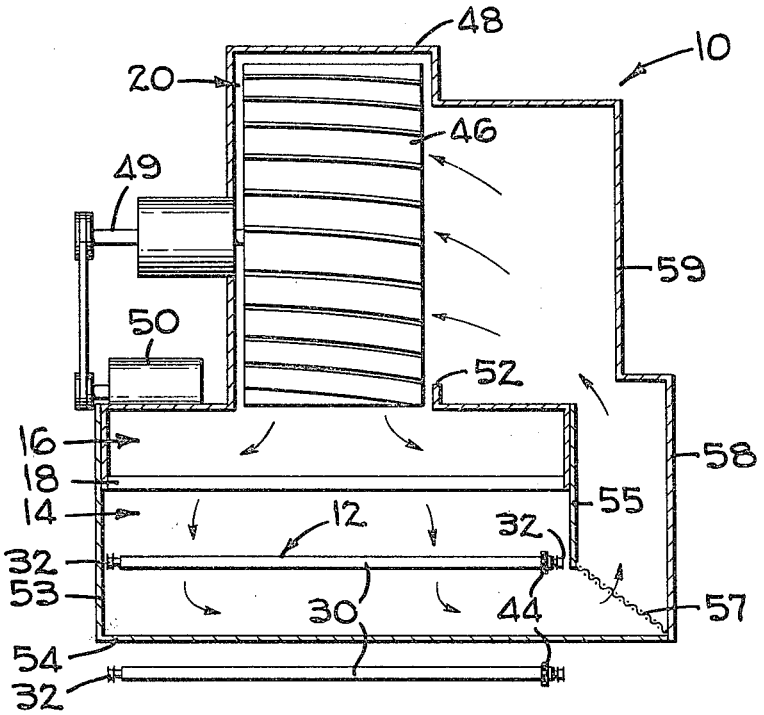
FIG. 2 is an enlarged section taken along line 2—2 of FIG. 1.

The conveyor 12 is a conventional roller conveyor comprising a pair of endless chains 32 having the individual rollers 30 suspended therebetween (FIG. 2). Each chain 32 is supported by a pair of sprockets 34*a*, 34*b* with only one such pair being visible in FIG. 1. The conveyor 12 extends outside of the drying chamber 14 at each end. The right end of the conveyor 12 (as viewed in FIG. 1) is adapted to receive fruit from a spray conveyor 36 where the fruit is sprayed with the wax solution. At the left end of the conveyor 12, the fruit is discharged onto a third conveyor 37 which carries the fruit away for packing. Neither conveyor 36 nor conveyor 37 form part of the present invention and reference is made to them only for explanatory purposes.

Figure 6:
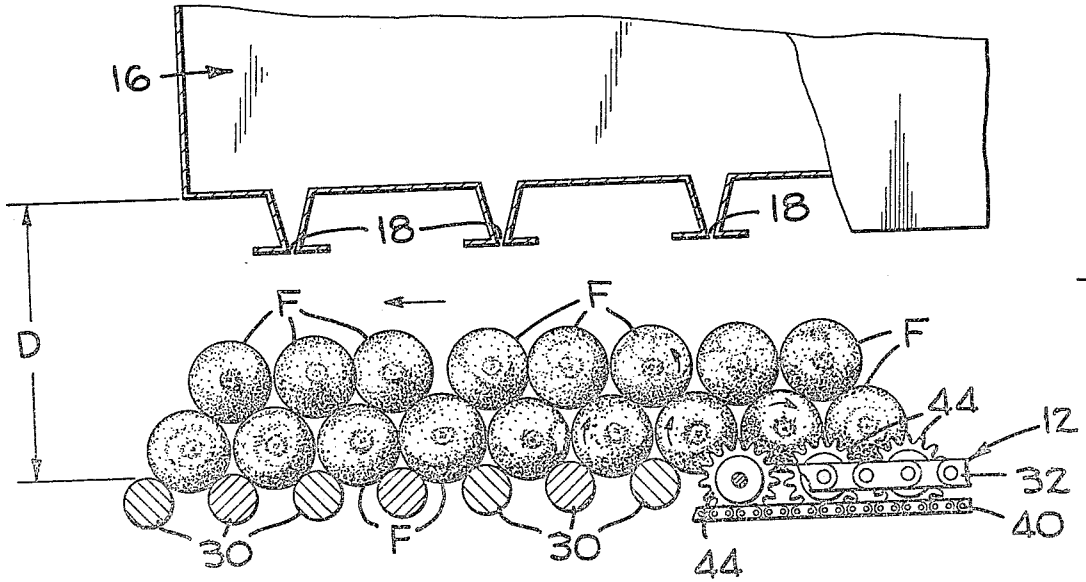
FIG. 6 is an enlarged detail showing the relation between the plenum and the conveyor of the present invention.

For citrus fruit, fruit F is supported on conveyor 12 in two layers (see FIG. 6). Such layering is achieved by operating the feed conveyor 36 with a feed rate twice that of the conveyor 12. It will be appreciated that the fruit will naturally form into two layers under these circumstances. For apples and other fruits which are sensitive to bruising, the fruit should be carried in a single layer on conveyor 12. To this end, the feed conveyor 36 is operated at the same rate as the conveyor 12.

The fruit F falls from the feed conveyor 36 onto the right end of the conveyor 12. The individual rollers 30 of the roller conveyor 12 are not rotated on this side of the dryer 10 so that the fruit remains stationary with respect to the conveyor. A means is provided to rotate the individual rollers 30 during the second half of travel 34 and, thus, to revolve the fruit so that all parts of the surfaces are exposed to the air flow. Said means includes a third endless chain 40 which is driven at a speed slower than that of the conveyor 12. By engaging a small sprocket 44 (FIG. 2) mounted on each individual roller against the chain 40, the difference in speed between the chain 40 and the conveyor 12 slowly rotates the individual rollers 30.

The third endless chain 40 is suspended between a drive sprocket 42 and an idler sprocket 43 (FIG. 1). The drive sprocket 42 is coaxial with, but smaller than, the two sprockets 34*a* mounted at the left end of the dryer 10, as viewed in FIG. 1. The drive sprocket 42 is mounted on a common axle (not shown) with the sprockets 34*a*, and it will be appreciated, therefore, that the chain 40 will be driven at a speed less than that of the endless chains 32.

The endless chains 32, and thus the conveyor 12, are driven by a motor 45 mounted near the inlet end of the dryer 10. A drive chain 45*a* connects a sprocket 45*b* on the motor with a second sprocket 45*c* mounted on a drive shaft 45*d*. The sprockets 34*b* are mounted on the drive shaft 45*d*, and rotation of the drive shaft by the motor drives the conveyor 12.

As previously pointed out, the chain 40 will impart a rotation to each of the individual rollers 30 in the downstream portion of the path of conveyor 12. The relative size of the sprockets 34*a*, 42 and 44 determines the speed of rotation of the individual rollers 30. The sizes are chosen so that the individual rollers complete approximately five rotations while passing through the second half of the dryer 10.

FIG. 2 is a cross-section taken at the upstream end of the dryer 10 illustrating the flow of air induced by the fan 20. The fan 20 is a conventional centrifugal fan having an impeller 46 mounted in a light sheet metal casing 48. The impeller 46 is mounted on a shaft 49 which is driven by a motor 50. Air enters the fan through a circular passageway 52 to the right of the impeller, as shown in FIG. 2, and is discharged beneath the impeller into the plenum 16. As described earlier, the air plenum 16 is an integral unit having only a single inlet and a plurality of identical outlets in the form of transverse nozzles 18. The single inlet is located directly beneath the impeller 46 and is adapted to receive air from the fan 20.

The chamber 14 beneath the air plenum 16 is formed of sheet metal and comprises a first wall 53 extending downward from the plenum 16, a bottom plate 54, and a second wall 55. The second wall 55 extends downward to the level of the conveyor 12 and terminates at that point. A screen 57 extends downward from the distal end of the second wall 55 to the bottom plate 54. The screen 57 acts to remove leaves and other debris from the air stream which is being recycled to the fan 20.

A passageway is formed on the outside of the second wall 55 and the plenum 16 by additional sheet metal casing 58. Air from beneath the conveyor 12 is drawn upward through the screen 57 and to the inlet of the fan 20 at the circular passageway 52.

Figure 3:
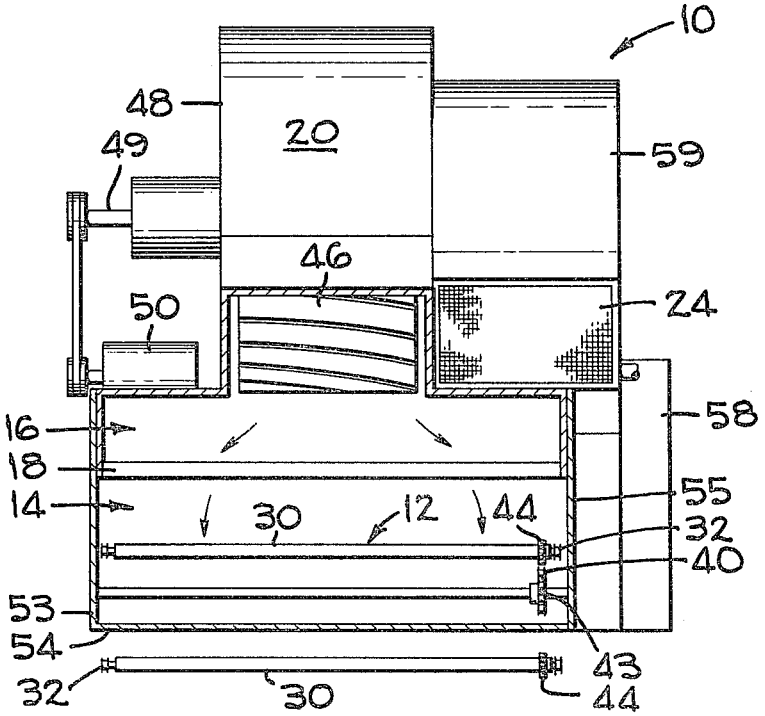
FIG. 3 is an enlarged section taken along line 3—3 of FIG. 1.

FIG. 3 is a cross-sectional view of the dryer, similar to FIG. 2, but taken just downstream of the air inlet 24. The air plenum 16 can now be seen to be a T-shaped section as it remains until the plenum terminates at the discharge end of the dryer. The outer passageway provided to recycle air to the fan, illustrated in FIG. 2, is no longer seen in FIG. 3. Instead, the second wall 55 extends downward until it meets the bottom plate 54. Thus, at this point, the inner chamber 14 formed beneath the air plenum is wholly enclosed. Air flowing into the chamber 14 must flow either toward the inlet end of the dryer 10 where it is recirculated to the fan 20 or toward the outlet end where it is expelled through the exhaust stack 22.

Air entering through inlet 24 flows toward the fan 20 through a duct 59 (see also FIG. 1). The heater (not illustrated) is housed within the duct 59. The heater is a conventional natural gas heater which will not be described further. Control of the heater and of the air temperature, however, will be described in greater detail hereinafter.

The endless chain 40, which provides for the rotation of the conveyor rollers 30, is illustrated in FIG. 3. It will be observed that the chain has not yet engaged the sprocket 44 on the roller 30 illustrated. The chain will engage the sprocket at a point just downstream of FIG. 3, as illustrated in FIG. 1.

Figure 4:
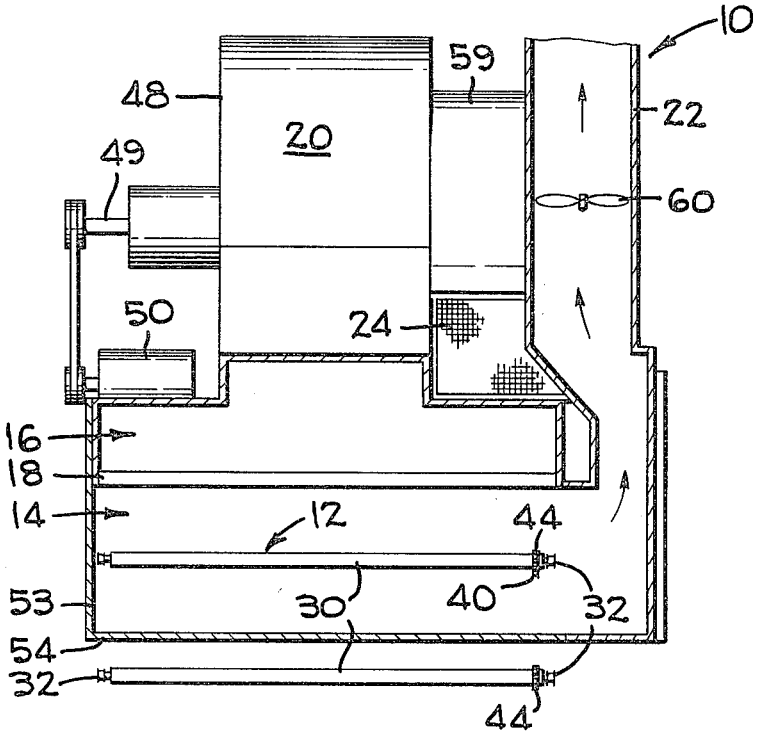
FIG. 4 is an enlarged section taken along line 4—4 of FIG. 1.

FIG. 4 is a cross-section of the dryer taken at a point near the discharge end thereof. FIG. 4 illustrates a cross-section of the exhaust stack 22 used to expel moist air from the dryer 10. The cross-section of the air plenum 16 has the same shape at this point as in FIG. 3. The air chamber 14 beneath the air plenum, however, has been extended to the right to form a passage which funnels air to the exhaust stack 22.

An axial fan 60 is provided in the exhaust stack to extract air in order to control the humidity of the air being recycled by the dryer. Dampers (not shown) within the exhaust stack allow the precise flowrate of extracted air to be controlled. It will be observed in FIG. 4 that the endless chain 40 has engaged the free sprockets 44 on the individual rollers 30 of the conveyor 12.

Figure 5:
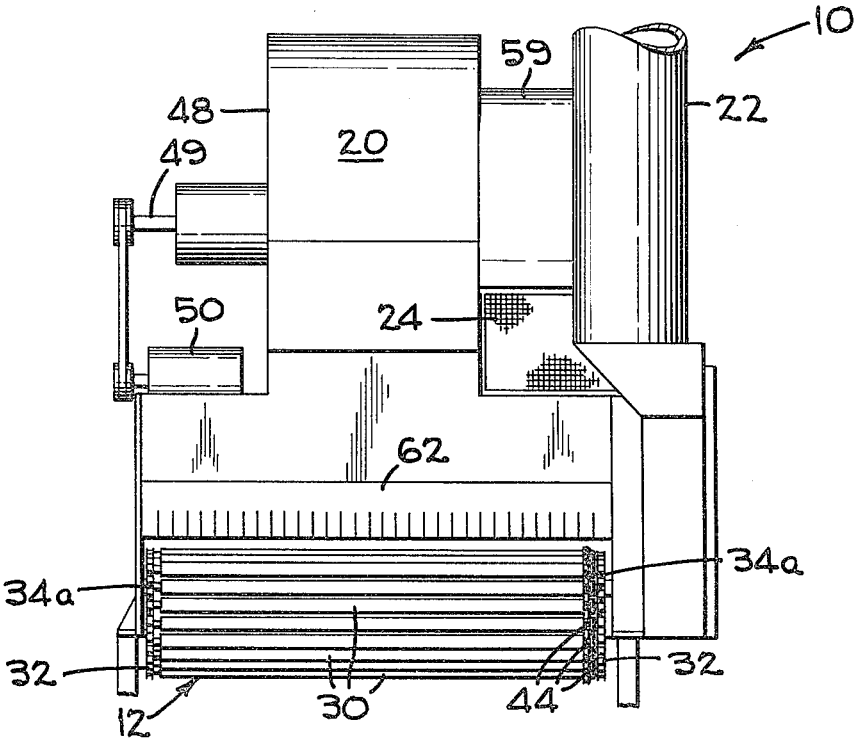
FIG. 5 is an end view of the dryer of the present invention.

FIG. 5 illustrates the discharge end of the dryer. A rubber skirt 62 is provided to limit the escape of air from the drying chamber to the atmosphere. Slits provided along the skirt allow fruit to pass therethrough unhampered. A similar skirt is provided at the inlet to the drying chamber but is not illustrated in the drawings.

FIG. 6 illustrates the relation between the air plenum 16 and the conveyor 12. The nozzles 18 are formed from the sheet metal of the plenum 16 and extend downward approximately two inches therefrom. Each nozzle 18 is formed by opposed walls that converge at an angle of approximately 15°, and the opening at the end thereof is approximately 0.1 inch. The bottom of the air plenum 16 is a distance D above the upper surface of the conveyor 12. For citrus fruits, where two layers of fruit are carried by the conveyor, the distance D will be approximately 10 inches. For apples, the distance D will be approximately 7 inches.

The individual rollers 30 in the preferred embodiment each have a diameter of approximately 1.7 inches and are located with centerlines three inches apart. In this way, the valley formed between adjacent rollers 30 is sufficiently large to support the individual fruit, but small enough to prevent fruit from falling through the interstices.

During travel through the second half of the dryer 10, the individual rollers 30 are rotated in the counterclockwise direction (as viewed in FIG. 6) and in the manner described hereinbefore. From the stacking pattern observed in FIG. 6, it will be appreciated that the rotation of the individual rollers will rotate not only the lower layer of fruit, but also the second layer of fruit directly in contact with the lower layer. The rotation of both layers acts to break contact points between the fruit and between the fruit and the rollers 30.

A typical dryer 10 constructed in accordance with the present invention has an air plenum 16 thirty feet long with 48 transverse air nozzles 18 spaced seven and a half inches apart. The air plenum 16 is approximately six feet wide. The associated conveyor 12 has the same width and is slightly longer to accommodate the receiving and discharge of fruit from the conveyor. The air fan 20 is sized to circulate 20,000 cubic feet per minute of air through the plenum and downward over the fruit. The exhaust fan purges approximately 5,000 cubic feet per minute of air from below the conveyor to lower the humidity of the circulating air. The pressure in the air plenum is maintained at approximately four inches of water, while the pressure in the drying chamber is at, or slightly below, atmospheric pressure. The velocity of the air stream as it passes through the tip of a nozzle is approximately 6,000 feet per minute. The velocity of the air streams diminish as they pass downward, but the velocity is still approximate 2,000 feet per minute as they strike the first layer of fruit.

The speed of the conveyor may be varied to adjust the residence time of the fruit in the dryer from approximately 1½ minutes to 2½ minutes. The temperature of the recirculated air stream may be adjusted from 90° to 130° F., depending on local drying conditions. As the humidity increases, an increase in temperature is necessary to effect complete drying. The user will select the lowest temperature consistent with complete drying in order to minimize energy consumption.

Although the best mode contemplated for carrying out the present invention has been herein shown and described, it will be apparent that modification and variation may be made without departing from what is regarded to be the subject matter of the invention.

What is claimed is:

1. A dryer for fruit or the like, comprising:

means defining a drying chamber;

means defining an endless roller conveyor having an upper fruit supporting run extending substantially the full length of said chamber, said roller conveyor including a plurality of individual rollers mounted in spaced relation to define air passages therebetween and which are free to rotate about their own axes;

means for driving said conveyor;

means defining a plenum chamber disposed longitudinally above the conveyor, said plenum chamber having a plurality of narrow generally rectangular nozzle openings extending transversely substantially the full width of said conveyor for directing a narrow curtain of high velocity heated and pressurized air from each nozzle for quickly evaporating moisture from the fruit;

air fan means for supplying heated air under pressure to the plenum chamber;

means for imparting rotary motion to individual rollers for no more than half of their residence time within the drying chamber, with the major portion of said rotary motion occurring during the latter portion of the residence time therein, the heated air discharged from said nozzle openings being in the form of narrow curtains of high velocity air which contact the upper exposed surfaces of the fruit and then move through passages between adjacent exposed surfaces of the fruit and the passages between said rollers for quickly evaporating moisture from the fruit in said chamber while the fruit is supported by said rollers, said rotary motion of the rollers being effective to turn the fruit for exposing all areas of the fruit to be heated by said high velocity air for evaporating substantially all moisture from the fruit prior to moving the fruit out of the drying chamber.

2. The dryer of claim 1 including means for recirculating a portion of the moisture-carrying air back to said air fan means after said air has passed through said rollers.

3. The dryer of claims 1 or 2 wherein said nozzle openings and said passages between said rollers are in successive repetitive alignment as said roller conveyor progresses through said chamber, thereby enhancing flow of said high velocity air curtains in drying said fruit.

4. A dryer for fruit and the like, comprising: means defining a drying chamber; means defining a single endless roller conveyor having an upper fruit supporting run extending substantially the full length of said chamber and having arcuate inlet and discharge end portions, said roller conveyor including a plurality of individual rollers which are free to rotate about their own longitudinal axes; means for driving said conveyor; means defining a plenum chamber disposed longitudinally above the conveyor and having upstream and downstream portions, said plenum chamber having a plurality of narrow generally rectangular nozzle openings extending transversely substantially the full width of said conveyor for directing a narrow curtain of high velocity heated and pressurized air from each nozzle for evaporating and blowing moisture from the fruit; air fan means for supplying the heated air under pressure to the plenum chamber; and power driven means for slowly rotating the rollers only while under approximately the downstream half of the plenum chamber including said arcuate discharge end portion for exposing all areas of the fruit to said heated air and to preclude pinching of small fruit when moving over said discharge portion, said rollers while moving below approximately the upstream half of said plenum chamber being precluded from rotation.

5. A dryer as in claim 4, wherein the means for continuously rotating the rollers includes:

an endless chain disposed beneath the upper surface of the conveyor, and a sprocket mounted on each roller, said sprockets engaging the endless chain whereby the rollers are rotated.

6. An apparatus according to claim 4 and additionally comprising an exhaust stack establishing fluid communication between said drying chamber and the atmosphere, and a driven exhaust fan in said exhaust stack for exhausting a portion of said heated air and evaporated moisture therein to the atmosphere, said fans cooperating to provide a pressure within said plenum chamber of about four inches of water, and a pressure in the drying chamber that is slightly below atmospheric pressure.

7. An apparatus according to claim 6 wherein said air is heated between about 90° F. to 130° F.; wherein said air fan provides about 20,000 cubic feet per minute of air which flows through said nozzles at about 6000 feet per minute, and wherein said exhaust fan purges about 5000 cubic feet of moist air per minute from said drying chamber, which chamber is about 30 feet long and provides a fruit residence time under the plenum chamber of about $1\frac{1}{2}$ to $2\frac{1}{2}$ minutes for lowering the humidity of the air circulated through the plenum chamber and for drying the fruit.

8. A fruit dryer for drying fruit having a longitudinally extending drying chamber and having a roller fruit conveyor extending through the drying chamber below a hot air plenum extending longitudinally above the drying chamber, characterized by: a plurality of longitudinally spaced apart nozzle openings extending cross-wise of the plenum for directing heated air at the fruit moving along the length of the conveyor; and by a second conveyor operating parallel to and slower than the roller fruit conveyor engaging and rotating the rollers on the fruit conveyor, said second conveyor starting at a position remote from an intake end of the drying chamber at approximately a second-half travel distance of the roller conveyor such that the rollers in the first-half distance of the roller conveyor are not driven whereas those in the second-half travel distance are driven.

9. A fruit dryer according to claim 8, further characterized in that the width of the plenum is substantially equal to the width of the roller conveyor and that the nozzle openings extend across the width of the plenum and depend toward the roller conveyor.

* * * * *